US005167371A

United States Patent [19]

Rohner

[11] Patent Number: 5,167,371

[45] Date of Patent: Dec. 1, 1992

[54] FAN JET NOZZLE

[75] Inventor: Markus Rohner, Oberriet, Switzerland

[73] Assignee: Wagner International AG, Switzerland

[21] Appl. No.: 705,319

[22] Filed: May 24, 1991

[30] Foreign Application Priority Data

May 31, 1990 [DE] Fed. Rep. of Germany ..... 4017594

[51] Int. Cl.[5] ..... B05B 1/04

[52] U.S. Cl. ..... 239/597; 239/601

[58] Field of Search ..... 239/595, 597, 599, 601

[56] References Cited

U.S. PATENT DOCUMENTS

| | | | |
|---|---|---|---|
| 1,753,443 | 4/1930 | Murray | 239/597 |
| 2,305,210 | 12/1942 | Wahlin | 239/601 |
| 2,743,138 | 4/1956 | Wahlin | 239/597 |
| 2,985,386 | 5/1961 | Steinen | 239/597 |
| 3,754,710 | 8/1973 | Chimura | 239/597 |
| 4,097,000 | 6/1978 | Derr | 239/599 |
| 4,646,977 | 3/1987 | Iwamura et al. | 239/601 X |

*Primary Examiner*—Andres Kashnikow
*Assistant Examiner*—William Grant
*Attorney, Agent, or Firm*—Hill, Van Santen, Steadman & Simpson

[57] ABSTRACT

A fan jet nozzle for surface coating, particularly for high-pressure spraying, is created whose inside dome is not fashioned rotationally-symmetrical. The dome interior is semicircular in the one plane of section in which the nozzle slot extends, but is ogive in the plane perpendicular thereto, the plane which is perpendicular to the lengthwise plane of the fan jet nozzle slot. The two sections, semicircular and ogive, steadily verge into one another around the center axis of the nozzle. The dome configuration results in less wear from abrasion of spraying fluid through the nozzle slot, in particular, onto the wall edge between the dome and the nozzle slot.

6 Claims, 2 Drawing Sheets

FAN JET NOZZLE

BACKGROUND OF THE INVENTION

The invention is directed to a fan jet nozzle for sprayer devices for coating workpieces with liquids, particularly for high-pressure spraying, comprising a cylindrical liquid delivery channel and a nozzle slot, whereby the cylindrical channel comprises a dome-like termination or hollow dome having a semicircular cross section in a plane of section passing through a center axis of the nozzle and whereby the nozzle slot penetrates from the outside into the dome. Such fan jet nozzles have been commercially available and in use for many years.

The useful life of these fan jet nozzles is limited as a consequence of abrasion of the edges of the slot, particularly given high-pressure spraying processes working at pressures up to 300 bar and when spraying liquids that contain solid particles (metal lacquer). Even when high-quality materials are employed for the nozzles, for instance sintered hard metals, abrasion can still significantly limit the useful life of fan jet nozzles.

SUMMARY OF THE INVENTION

It is therefore an object of the present invention to fashion such fan jet nozzles such that abrasion is reduced and, thus, the useful life of the nozzle is lengthened. This object is achieved by fashioning the dome which feeds spraying fluid into the nozzle slot in a rotational-asymmetrical fashion with respect to a center axis of the nozzle such that the dome comprises a semicircular cross section only in a first plane of section through the center axis of the nozzle that coincides with a lengthwise plane or flatwise plane of the nozzle slot, but has a cross section in the form of an ogive in a second plane of section through the center axis of the nozzle residing perpendicularly to the first plane. The ogive is formed of two sub-circles that proceed from a common point on the center axis of the nozzle, the common point coinciding with the point of intersection of the semicircular cross section of the first plane of section with the center axis of the nozzle. The two subcircles proceed symmetrically on both sides of this axis and enter tangentially into the walls of the cylindrical channel. The radii of the sub-circles is larger than a semicircular radius of the semicircular cross section of the lengthwise plane of section. The semicircular and ogive cross section steadily verge into one another around the center axis of the nozzle.

The invention is based on the perception that an edge angle of inside lengthwise edges of the nozzle slot of the nozzle defines the rate of wear. More particularly, the rate of wear is lower or, respectively, wear proceeds more slowly the larger this edge angle is. As a result of the non-rotational-symmetrical design of the inner dome of the nozzle of the invention, this edge angle can be made significantly larger, resulting in a considerably enhanced useful life of the nozzle without the efficiency of the nozzle being deteriorated due to this configuration.

DETAILED DESCRIPTION OF THE PREFERRED EMBODIMENTS

Figure 1:
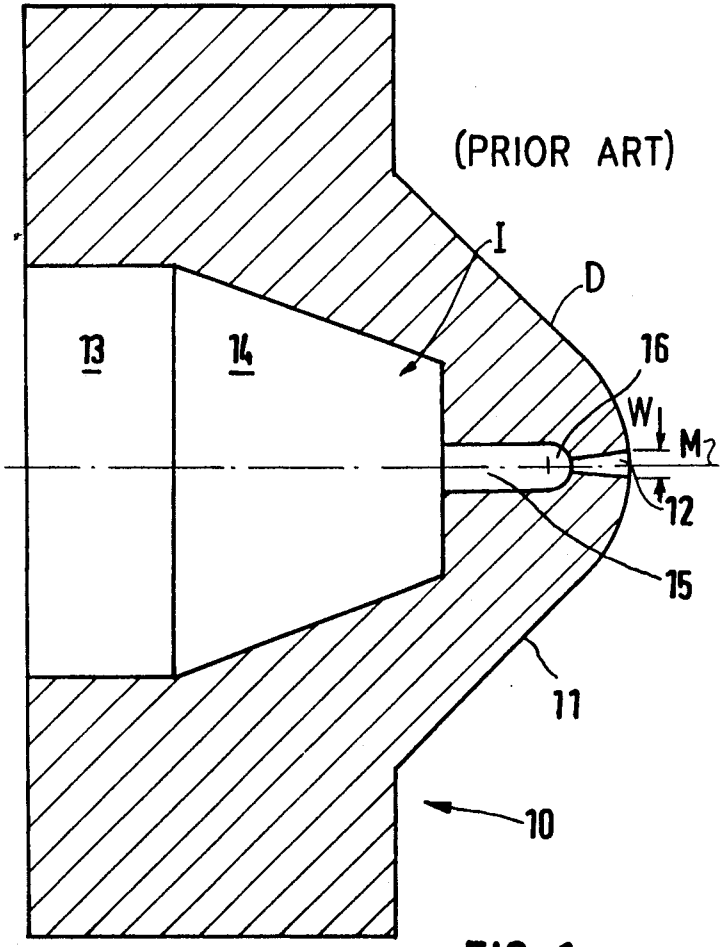
FIG. 1 is an enlarged sectional view taken perpendicular to the nozzle slot through a fan jet nozzle of the prior art.

FIG. 1 shows a fan jet nozzle 10 of a known type which comprises a dome-like convex shape D at its outer front side as seen in spraying direction, whereby a nozzle slot 12 that spreads lengthwise or flatwise perpendicular to the plane of FIG. 1, and perpendicular to a nozzle axis M, is formed into the dome 11. In other words, the cross section of the nozzle slot has a widthwise dimension W, variable along an axial extent of the nozzle slot 12 along the axis M, which is smaller than a lengthwise dimension into and out of the plane of FIG. 1. These dimensional relationships are typical for a fan jet nozzle.

This nozzle slot 12 is in communication with an interior I of the nozzle that supplies a spray agent during spraying operation, whereby this interior—as seen in the direction from the back toward the front of the nozzle to the nozzle slot 12 comprises a cylindrical part 13 having a large diameter, a conical part 14 following thereupon and tapering toward the front of the nozzle, a cylindrical part 15 and a spherical dome 16 following thereupon into which the nozzle slot 12 cuts. The dome 16 is rotational-symmetrical relative to the central axis M of the nozzle and has the shape of a semicircle.

Figure 2:
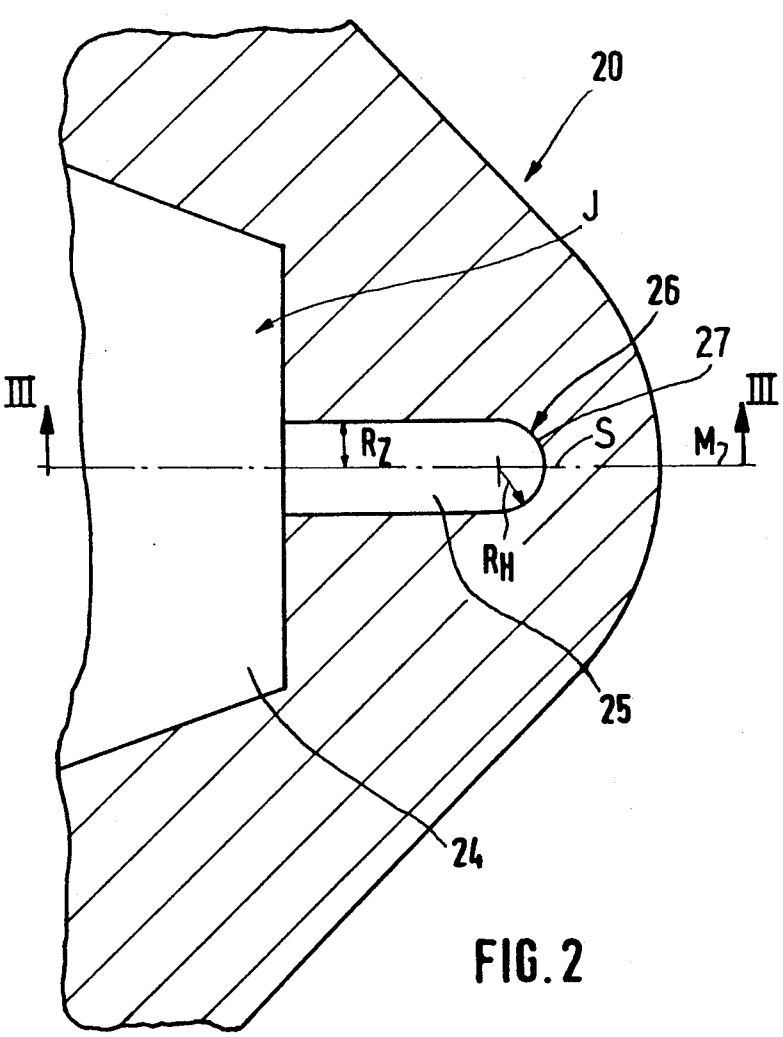
FIG. 2 is a more enlarged sectional view through a fan jet nozzle blank of the invention, whereby the nozzle slot still to be cut into the blank will lie flatwise in the plane of section of FIG. 2.
Figure 3:
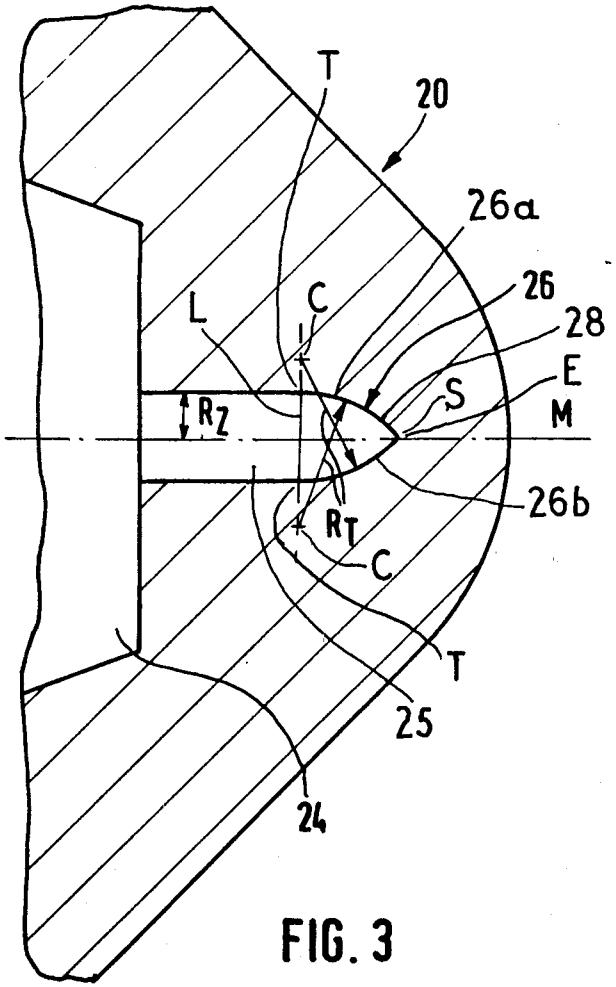
FIG. 3, in the scale of FIG. 2, is a sectional view taken along III—III of FIG. 2, in a plane of section turned by 90° relative to that of FIG. 2.

FIGS. 2 and 3 show enlarged sections through a modified fan jet nozzle 20 of the invention, particularly through the foremost region of interest. The nozzle blank is shown, i.e. the nozzle slot has not yet been introduced. Like the nozzle 10 of FIG. 1, the modified nozzle 20 of FIGS. 2 and 3 comprises an interior J that is composed of a cylindrical part (not shown) having a large diameter, a conical part 24, a cylindrical part 25 having a small diameter and a modified dome 26 that terminates the cylindrical part. The conical part 24 and cylindrical part 25 correspond to the conical part 14 and the cylindrical part 15 of the known nozzle of FIG. 1. The difference between the modified nozzle 20 compared to FIG. 1 is in the modified dome 26.

By contrast to the spherical dome 16 of FIG. 1 that is rotationally-symmetrical relative to the nozzle axis M, the modified dome 26 of FIGS. 2 and 3 is not rotationally-symmetrical. The special shape of the modified dome 26 is described by viewing two sections perpendicular to one another. In a first plane of section shown in FIG. 2, the modified dome 26 —like that of FIG. 1—comprises the shape of a semicircle 27 having a radius $R_H$ equal to the radius $R_Z$ of the cylindrical part 25. In a second plane of section of FIG. 3, turned by 90° from the first plane of FIG. 2, the modified dome 26 comprises the shape of an ogive 28. This ogive 28 is composed of two identical sub-circles **26*a* and 26*b* that proceed from a starting or intersection point S on the nozzle axis M symmetrically vis-a-vis this axis M and discharge tangentially into the cylindrical part 25. Radii $R_T$ of the two sub-circles 26*a*, 26*b* are larger than the radius $R_H$ of the semicircle in the section of FIG. 2**, whereby centers C, C of the circles lie on a line L indicated with broken lines in FIG. 3 that passes through the tangent points T between the sub-circles 26*a*, 26*b* and the cylindrical part 25. The starting point S of the sub-circles 26*a*, 26*b* on the nozzle axis M is identical to the intersection point of the dome semicircle 27 in FIG. 2 that is likewise referenced S in FIG. 2. The dome 26 verges continuously around the axis M, from the semicircle cross section 27 of FIG. 2 to the ogive cross section 28 of FIG. 3, so that a volume form derives for the dome interior that has a steady curvature change everywhere with the exception of an ogive edge E of the plane of section of FIG. 3, whereby this edge, however, runs out in a rounded portion toward the cylindrical part 25. When the modified dome 26 is viewed in cross sections (sections perpendicular to the center axis M), then these cross sections, proceeding from the front, have the shape of any extremely narrow lens that becomes thicker and thicker and ultimately verges into a circle when the cylindrical part 25 is reached.

For finishing the nozzle, a nozzle slot is formed into the blank 20 of FIGS. 2, 3, in particular such that the lengthwise axis or flatwise axis of the nozzle slot 12 is situated in the first plane of section of FIG. 2, i.e. resides perpendicularly vis-a-vis the second plane of section of FIG. 3.

Figure 4:
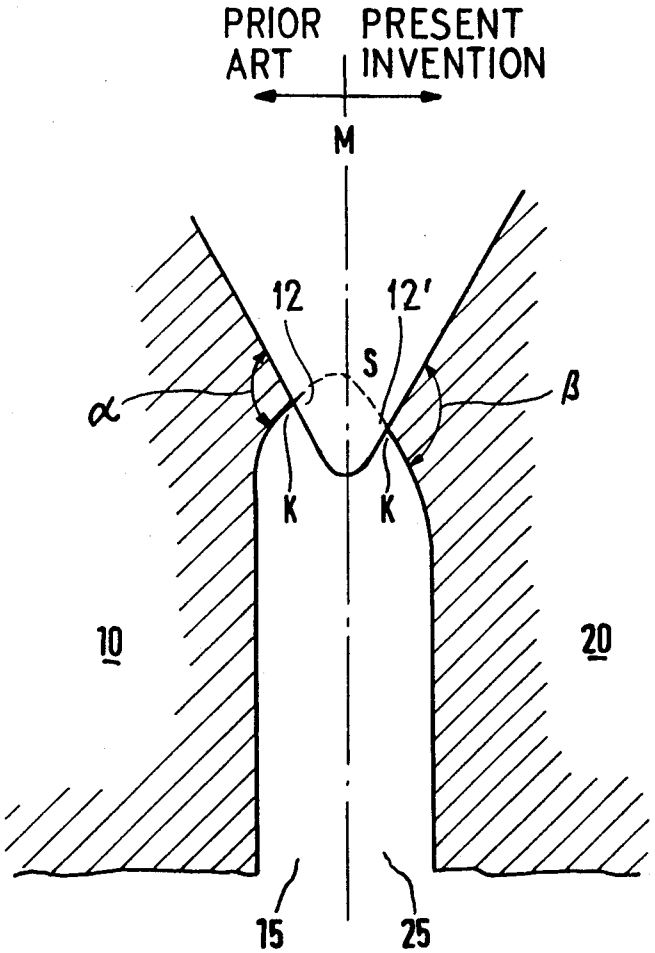
FIG. 4, in a more enlarged scale, is a partial sectional view of the nozzle of FIG. 1 on the left side of FIG. 4 and a sectional view of a nozzle of the present invention on the right side of FIG. 4.

The influence of the special design of the modified dome 26 in the finished nozzle, i.e. when the nozzle slot is cut in, shall be set forth with reference to FIG. 4, namely by comparison to the known nozzle 10 of FIG. 1. The known nozzle 10 is thereby shown at the left side of the center axis M and the modified nozzle 20 of the invention is shown for comparison at the right side thereof. It is evident that the derived edge K that extends along the entire slot length—at both sides—defines the slot width and is obviously exposed to the greatest wear during spraying work. Expressed in other words, this edge K that represents the breach line of the nozzle slot 12 or corresponding slot 12' through the spherical dome 16 or the modified dome 26 respectively, defines the useful life of the nozzle, i.e. this edge K wears comparatively quickly, with the result that the nozzle must be replaced even though all other wall regions of slot and dome exhibit little wear. When the left-hand side and the right-hand side of FIG. 4 are then compared, one can see that the edge angle $\alpha$ in the nozzle 10 having the semicircular dome 16 is significantly smaller than the edge angle $\beta$ in the nozzle 20 of the invention having the modified dome 26, which is significantly larger than 90°. In that the edge angle $\beta$ in the nozzle 20 is enlarged to form a large angle, significantly reduced wear derives at the edge K, with the consequence of a considerably enhanced useful life of the nozzle. The fact that the edge angle at the widthwise or narrow sides of the nozzle slot would still roughly corresponds to that in the known nozzle 10 is insignificant because these narrow sides are extremely short. At any rate, extended time tests have shown that the useful life of the nozzle can be at least doubled by this inventive shaping of the dome.

Since fan jet nozzles are manufactured in the greatest variety of sizes, no generally valid dimensional particulars can be provided here. The following dimensional particulars are to be considered only as preferred examples. In most such nozzles, the cylindrical part 15, 25 has a radius $R_Z$ of 0.1 through 1.5 mm; the essentially equal radius $R_H$ is thus established for the semicircle of the section in FIG. 2. The radius $R_T$ of the subcircles 26*a*, 26*b* of the modified dome 26 in the section of FIG. 3 is, as mentioned, to be selected respectively larger, preferably in the range between 1.4:1 and 3.0:1 compared to $R_Z$ and $R_H$.

The nozzle of the invention is particularly intended for what is referred to as airless high-pressure spraying wherein work is carried out with extremely high liquid pressures but also can be utilized in spraying methods working with lower pressures, for instance in a combined compressed air/high-pressure process or, respectively, even in exclusive compressed air processes. All standard nozzle materials, particularly sintered metals such as, for instance, hard metals are suitable as materials. The introduction of the nozzle slot likewise ensues in a standard way by being ground in; however, care is to be exercised to see that the lengthwise axis of the nozzle slot in fact comes to lie in the plane of section of FIG. 2.

Although the present invention has been described with reference to a specific embodiment, those of skill in the art will recognize that changes may be made thereto without departing from the scope and spirit of the invention as set forth in the appended claims.

I claim as my invention:

1. In a fan jet nozzle for sprayer devices having a cylindrical liquid delivery channel and a nozzle slot, whereby the cylindrical channel terminates in an interior dome and whereby the nozzle slot cuts into the dome, the improvement comprising:

the dome is rotational-asymmetrically fashioned with respect to a center axis of the nozzle such that the dome has a semicircular cross section only in a first plane of section through said center axis of the nozzle, said first plane coinciding with a lengthwise plane of the nozzle slot, and said dome has a second cross section in the form of an ogive in a second plane of section through said center axis of the nozzle, said second plane perpendicular relative to said first plane, said ogive being formed of two sub-circles that proceed from a common point on the center axis of said nozzle, said common point coincides with an intersection point of said semicircular cross section in said first plane of section with the center axis of the nozzle and, proceeding symmetrically at both sides of said axis, said sub-circles enter tangentially into said cylindrical channel, whereby the radius of each of the sub-circles is larger than a semicircle radius of the semicircular cross section of said first plane of section; and said dome steadily verges in cross section around said center axis of the nozzle between said semicircular and said ogive cross sections.

2. The improvement of claim 1, wherein the ratio of the sub-circle radii of said ogive cross section to the semicircle radius of the semicircular cross section are between 1.4:1 and 3.0:1.

3. In a fan jet nozzle for sprayer devices having a cylindrical liquid delivery channel and a nozzle slot, whereby the cylindrical liquid delivery channel terminates in an interior dome and whereby the nozzle slot cuts into the dome, the improvement comprising:

the dome is rotational-asymmetrically fashioned about a center axis at said nozzle, having an ogive cross section in a place of section perpendicular to a lengthwise plane of the nozzle slot; and wherein said ogive cross section is formed of two sub-circles that proceed from a common point on the center axis of the nozzle, said two sub-circles having radii which are greater than a radii of said cylindrical channel, said two sub-circles proceed tangentially into merging relationship with said cylindrical channel.

4. The improvement of claim 3, wherein said dome comprises a semicircular cross section in a plane of section which coincides with said lengthwise plane of said nozzle slot.

5. The improvement of claim 6, wherein said common point coincides with an intersection of said semicircular cross section with the center axis of said nozzle.

6. The improvement of claim 5, wherein the ratio of the sub-circle radii of said ogive cross section to the semicircle radius of the semicircular cross section are between 1.4:1 and 3.0:1.

* * * * *